United States Patent [19]

Byrd

[11] Patent Number: 4,934,712

[45] Date of Patent: Jun. 19, 1990

[54] WEIGHTED OBJECTS WITH TETHER AND MEANS FOR TWISTING TETHER TO RAISE AND LOWER OBJECTS

[76] Inventor: Thomas R. Byrd, P.O. Box 1386, Santa Barbara, Calif. 93102

[21] Appl. No.: 844,194

[22] Filed: Mar. 26, 1986

[51] Int. Cl.[5] ..... A63B 67/10

[52] U.S. Cl. ..... 273/333; 272/31 A; 273/393; 273/DIG. 24; 446/146; 446/231; 446/243

[58] Field of Search ..... 272/8 R, 8 D, 31 R, 272/31 A, 31 B, 31 P; 273/1 G, 1 GA, 39, 58 E, 58 G, 127 R, 127 A, 128 R, 336, 339, 413, 444, DIG. 24, 331, 333, 386, 393; 446/47, 48, 146, 168, 231, 243, 485; 362/806, 811

[56] References Cited

U.S. PATENT DOCUMENTS

| | | | |
|---|---|---|---|
| 471,883 | 3/1892 | Nichols | 273/337 |
| 650,948 | 6/1900 | Nelson | 273/127 D |
| 1,505,942 | 8/1924 | Blanton | 446/363 X |
| 1,641,707 | 9/1927 | Strigl | 272/31 A |
| 1,790,405 | 1/1931 | Brown | 273/331 |
| 1,835,857 | 12/1931 | Foehl | 273/39 |
| 1,853,567 | 4/1932 | Marx | 272/31 A |
| 2,010,156 | 8/1935 | Jimerson | 446/262 |
| 2,075,267 | 3/1937 | Christiansen | 272/31 A |
| 2,216,899 | 10/1940 | Berger | 272/31 A |
| 2,618,891 | 11/1952 | Pepin | 446/146 |
| 2,779,595 | 1/1957 | Ensley | 272/31 B |
| 2,937,870 | 5/1960 | Berger | 272/31 A |
| 3,055,660 | 9/1962 | Alexander | 272/31 A |
| 3,272,507 | 9/1966 | Grau | 272/31 A |
| 3,428,310 | 2/1969 | Leath | 272/31 R |
| 3,477,157 | 11/1969 | Paquette | 40/432 |
| 3,596,399 | 8/1971 | Barbee | 272/31 A |
| 3,649,018 | 3/1972 | Beam | 273/386 |
| 3,698,800 | 10/1972 | Belgau | 273/413 X |
| 3,740,032 | 6/1973 | Chang | 272/31 B |
| 3,762,702 | 10/1973 | Keele et al. | 272/31 A |
| 3,907,285 | 9/1975 | Lettieri | 272/31 A |
| 3,917,264 | 11/1975 | Davidson et al. | 273/3 R |
| 4,009,879 | 3/1977 | Wolf | 272/31 A |
| 4,095,784 | 6/1978 | Kennedy et al. | 272/31 A |
| 4,179,685 | 12/1979 | O'Maley | 382/7 |
| 4,226,422 | 10/1980 | Belli | 273/368 |
| 4,286,780 | 9/1981 | Vermeire | 273/DIG. 24 X |
| 4,435,917 | 3/1984 | Lee | 446/47 |

FOREIGN PATENT DOCUMENTS 87713 6/1987 PCT Int'l Appl. .

*Primary Examiner*—Richard T. Stouffer

*Attorney, Agent, or Firm*—Knobbe, Martens, Olson & Bear

[57] ABSTRACT

A weighted object is attached to a tether and the tether is twisted to cause the weighted object to spin and to change in vertical position. The apparatus which causes the tether to twist can also orbit through a path to cause horizontal motion of the weighted object thereby providing three-dimensional movement to the weighted object. Movable objects are provided as targets for the weighted object with points being given for producing interaction between the weighted object and the movable objects. Also, due to the resonance properties of the tether, many different sculptural forms within the harmonies can be created. By stroboscopically illuminating the tether, further visual forms can be observed. By pulsating the lights on the weight many visual effects can be produced along with altering the tether to produce special effects for film.

49 Claims, 10 Drawing Sheets

WEIGHTED OBJECTS WITH TETHER AND MEANS FOR TWISTING TETHER TO RAISE AND LOWER OBJECTS

BACKGROUND OF THE INVENTION

This invention relates to games and toys in general and more particularly to devices in which the path of motion of a movable object is controlled by the operator.

This device also produces a multitude of different sculptural forms and shapes which can be created by resonance in the tether as well as many permutations of light patterns resulting from the spinning weight. One can appreciate these aspects of the invention on a purely aesthetic level like any artwork, thus qualifying this invention as a kinetic sculpture.

With or without minor adaptations this invention can be used to produce special effects for motion pictures. The weight can be made to resemble a spaceship in shape along with specific light arrangements, and tether adaptions for film.

There are a variety of toys in which a movable object is controlled by a participant. Examples of such toys include radio-controlled airplanes, boats and cars. However, radio-controls are complex in nature and relatively expensive. Also, radio controls must be handled carefully in order to avoid damage.

More simple toys are known in which a remote control is operated through a tether or the like. However, the range of movement of these toys is extremely limited and control is quite minimal. Accordingly, there is need for a remotely-controlled toy.

U.S. Pat. No. 1,790,405 to Brown discloses a toy which includes an arm which is rotated by a pin such that the arm will rise or fall due to centrifugal force.

U.S. Pat. No. 2,075,267 to Christiansen discloses a toy airplane on a radial arm. The connection between the airplane and the arm is such that the airplane may bank one way or the other and may also tilt upwards or downwards.

U.S. Pat. No. 2,779,595 to Ensley shows a toy which is mounted on an arm. A flexible cable extends through the arm which causes the toy to rotate while the arm itself may be rotated about a central pivot point.

U.S. Pat. No. 2,937,870 to Berger shows a remote-controlled toy which is mounted on a flexible cord. The toy is manipulated by rotating a pylon to which a tether is attached.

U.S. Pat. No. 3,055,660 to Alexander discloses an apparatus for flying airplanes which includes a motor mounted on a horizontal support such as a ceiling. The motor rotates an arm to which the model airplane is attached.

U.S. Pat. No. 3,272,507 to Grau discloses a tethered toy. A model airplane is mounted on one end of the tether and a counterweight is mounted on the other end. The tether is rotated through a pivotable support.

U.S. Pat. No. 3,596,399 to Barber shows a tethered model airplane in which the tether can be reeled in or payed out.

U.S. Pat. No. 3,762,702 to Keele et al shows a remote-controlled, tethered toy in which a pair of airplanes are suspended from individual arms.

U.S. Pat. No. 3,907,285 to Lettieri shows a toy having a plurality of rotatable members U.S. Pat. No. 4,095,784 to Kennedy et al discloses a toy aircraft system within an aircraft which is powered by an electrically-driven propeller and motor mounted in the aircraft.

SUMMARY OF THE INVENTION

One of the objects of the present invention is to provide a suspended object attached to a motor by a tether in which the vertical distance between the motor and the suspended object is changed by the motor supercoiling the tether A second object of the present invention is to provide a device which produces the appearance of flight and which can be controlled in both vertical and horizontal movement through a relatively simple mechanism.

Another object of the present invention is to provide a game which includes a remotely-controlled object in which the object is maneuvered, through, around, and into various stationary objects as well as to knock over targets in order to score points.

A still further object of the present invention is to provide a game, kinetic sculpture or toy which may either be a permanent installation or may be portable.

In accordance with the above and other objects, the present invention is a device having a motor which rotates a shaft. A rotatable device is connected to the shaft and a tether has one end attached to the rotatable device so as to be twisted or supercoiled by the shaft A second end of the tether is attached to a weight The motor is a variable speed motor such that, as the motor speed varies, the twist in the tether increases or decreases thus raising or lowering the weight and at the same time causing the weight to spin about its central axis. The motor which supercoils the tether causing it to contract can be reversed which results in the uncoiling of the tether at a faster rate than if the weight alone were to uncoil the tether.

In accordance with other objects of the present invention, the rotatable device to which the tether is connected may be mounted in a second movable member so that the rotatable device revolves about a central axis. The second movable member may be connected to the motor for rotation by the motor or may be connected to a second motor such that the speed of rotation of the rotatable device and the speed of rotation of the second movable member can be varied individually.

In accordance with further aspects of the invention, a remote control is provided for controlling the speed and direction of rotation of the motor or motors.

Yet another object of this device is to produce various harmonic resonances in the tether by controlling the speed of the motor and by intentionally or not producing knots in the supercoiling tether.

Another object of this invention is to provide a method for creating a visual effect of a flying object by using a non-photographic blue-colored tether and lights on the weighted object pulsating at a compatible frequency with the speed of the camera exposure.

Another object of this invention is to produce visual effects on the tether with a variable speed strobe illuminating the string, and a control of frequency to the strobe.

Another object of this invention is to produce visual effects on the suspended object by placing a light or lights on the weighted object in strategic locations and set their pulse rate at the same or different frequencies.

Another object of this invention is to provide different shaped weighted objects that react differently to the torque resulting from the supercoiling tether, e.g., a disk shape, a sphere, an elongated shape, a donut shape, etc.

Another object of this invention is to demonstrate different scientific principals, e.g., centripetal force, stroboscopic phenomena, gyroscopic phenomena, light mixing phenomena, wave harmonies, etc.

The invention also includes stationary objects to be used as targets for the weight. The stationary objects may include openings through which the weight must pass to score points, movable objects to be knocked over by the weight to score points, banked turns along which the weight can travel, etc.

BRIEF DESCRIPTION OF THE DRAWINGS

The above and other objects of the present invention will become more readily apparent as the invention is more fully understood from the detailed description below, reference being had to the accompanying drawings in which like reference numerals represent like parts throughout, and in which.

DETAILED DESCRIPTION OF THE PREFERRED EMBODIMENTS

Figure 1:
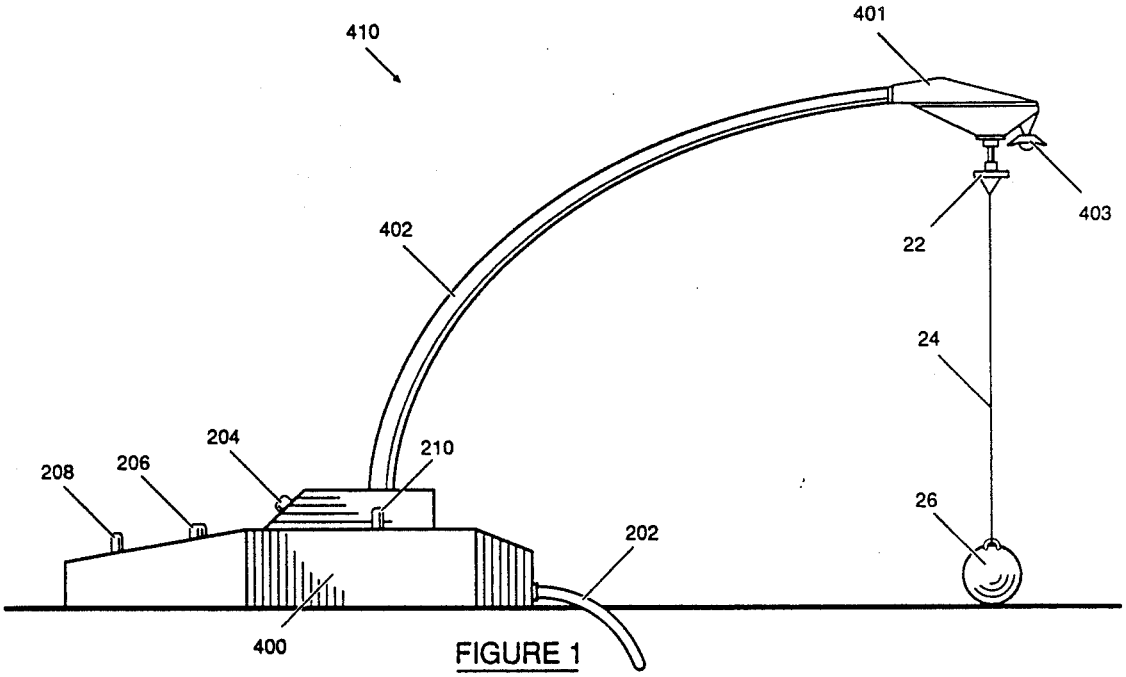
FIG. 1 is an elevational view of a kinetic sculpture according to the present invention.
Figure 2:
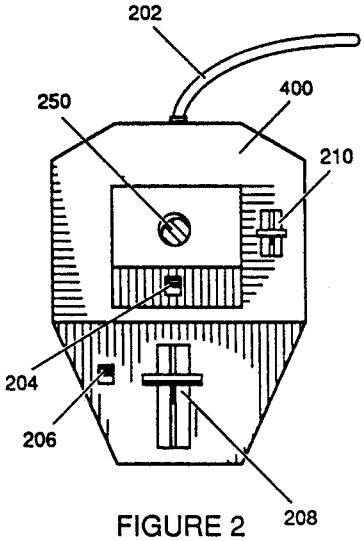
FIG. 2 is a top view of one possible form of the control panel of the embodiment of the invention in FIG. 1.

FIG. 1 shows an embodiment of the invention which is an art piece 410 which produces a whole array of visual effects. FIG. 2 shows a top view of the control box 400 for the art piece 410. As shown in FIGS. 1 and 2, the art piece 410 comprises a base 400 which also has the controls to the strobe 403 and the single motor which drives the rotating device 22 which coils the tether 24 attached to the weight 26. An arm 402 supports the motor housing 401. The wires controlling the speed of the motor and the rate of the strobe 403 pass out of the control base 400 at opening 250 and up to the motor housing 401 through said arm 402. Slide switch 210 controls the pulse rate of strobe 403 which is directed downwards to illuminate the tether 24 and the weight 26. Switch 208 controls the speed of the motor attached to the turning device 22. Other aspects of the drawings include the power cord 202, the slide control 208 to the motor, the forward reverse switch 206 and the on-off switch 204

Figure 3:
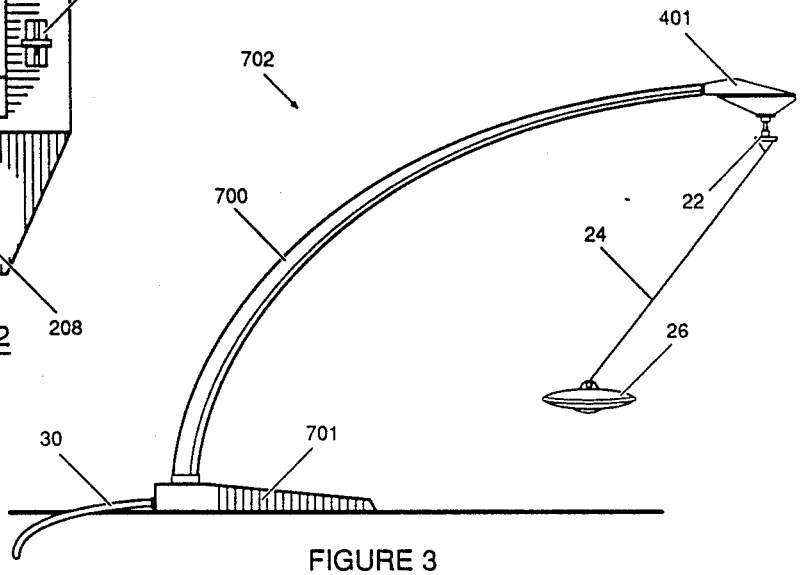
FIG. 3 is an elevational view of an arch support for the motor housing of the present invention.

FIG. 3 is a side view of a base support 702. A base 701 is heavy enough to support the arm 700 which connects to motor housing 401. The control cable 30 travels up the arm 700 to the motor housing 401.

Figure 4:
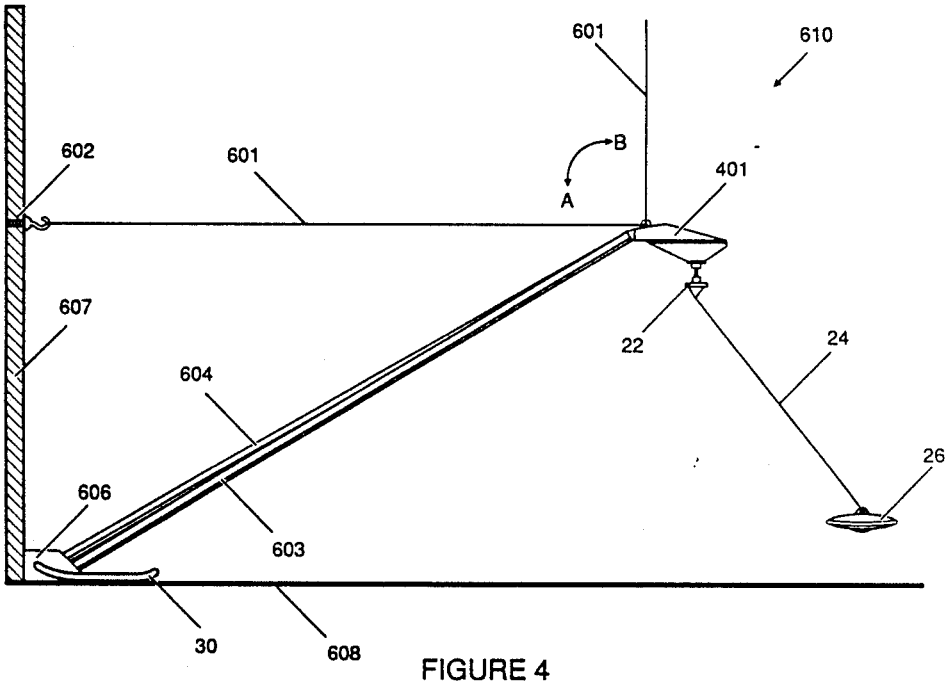
FIG. 4 is an elevational view a two-legged support for the motor housing of the present invention butting against the wall and floor.
Figure 5:
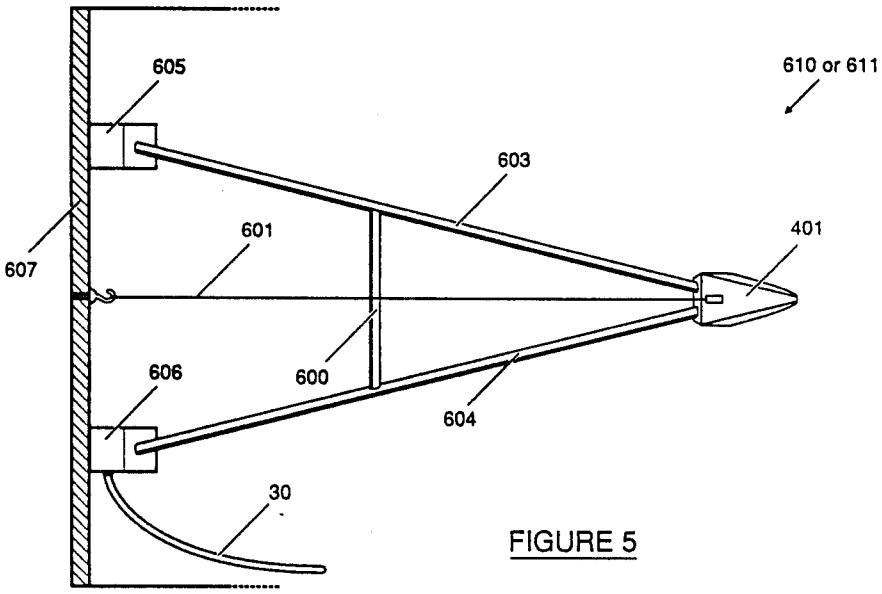
FIG. 5 is a top view of the two-legged support.
Figure 6:
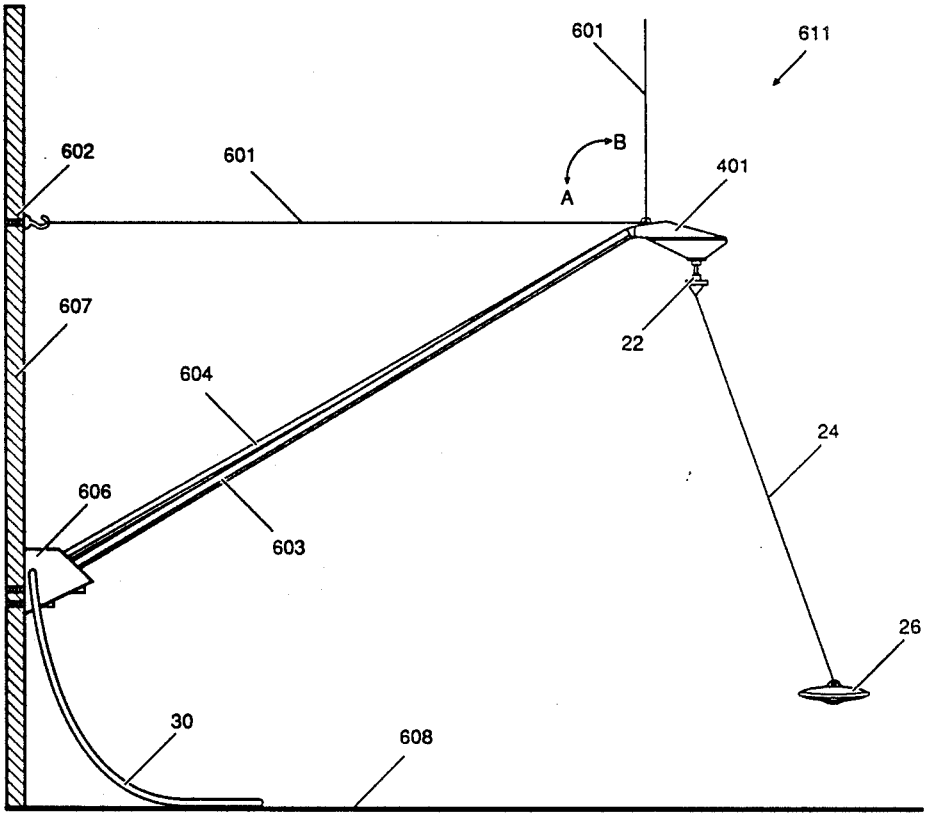
FIG. 6 is an elevational view of the two-legged support with wall braces butted against the wall.

FIG. 4 is an elevational view of a two-legged support system 610. FIG. 5 is a top view of the two-legged support 610 in FIG. 4 or the two-legged support 611 in FIG. 5, which will be discussed later. The motor housing 401 can hold any of the offset motor systems discussed below or a single motor. The two legs 603 and 604 support the motor housing 401 and fit into grips 605 and 606 which can be either attached (permanently or not) to the floor 608 or to the wall 607 as shown in FIG. 6. The cable 30 travels up either leg 603 or 604 to the motor housing 401. A string 601 attaches to the motor housing 401 and to a mount 602 which is embedded either in the wall 607 or into the ceiling. An optional crossbar 600 is shown in FIG. 5. The mount 602 is preferably mounted in the plane bisecting the support system, see FIG. 5. The angle of the string 601 radiating from the motor housing can vary anywhere from A to B in FIG. 4 or FIG. 6.

Figure 7:
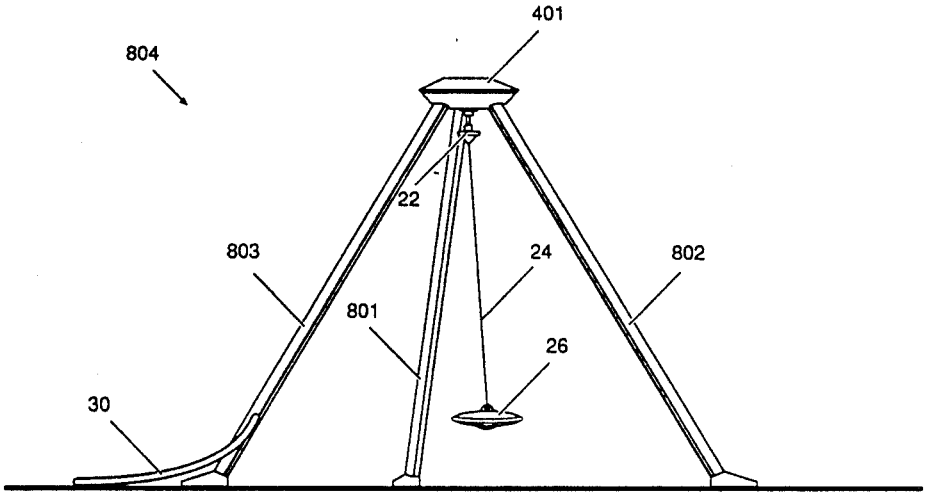
FIG. 7 is a three-legged support for the motor housing.

FIG. 7 is a side view of a tripod support 804. It is noted that more than three legs can be used. The three legs 801, 802 and 803 support the motor housing 401. The control cable 30 travels up one of the legs to the motor housing 401.

Figure 8:
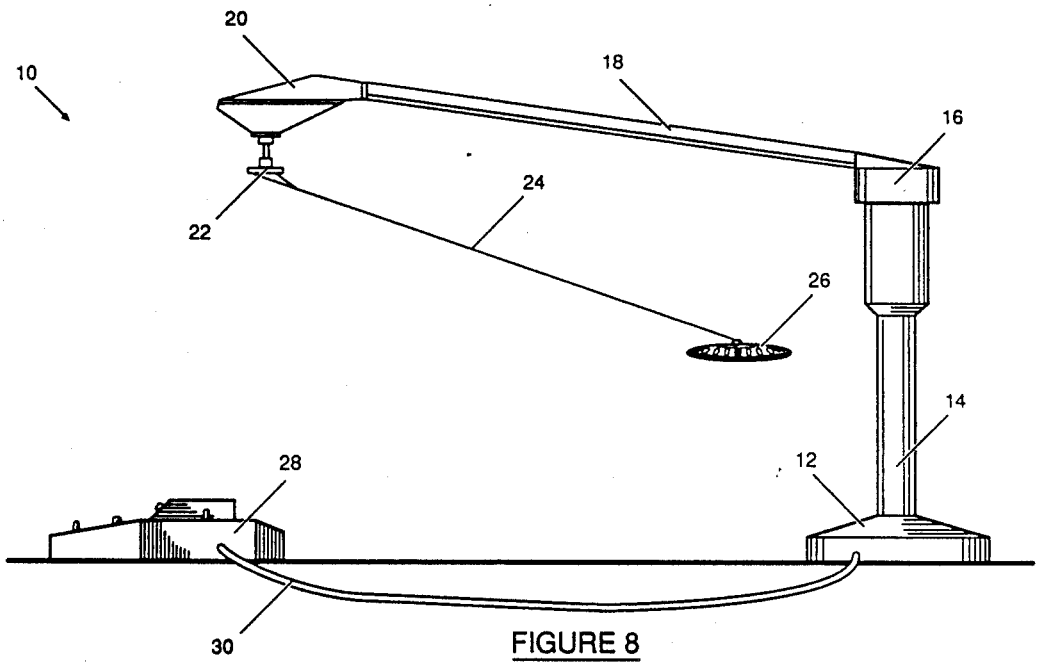
FIG. 8 is an elevational view of one possible form of a toy according to the present invention.

FIG. 8 shows the possible basic component of toy 10. This embodiment comprises a stand having a base 12 and a stationary vertical support member 14. A rotatable cap 16 is mounted to the vertical support 14 and is connected to a support arm 18. A power head 20 is mounted on the end of support arm 18 and cap 16 can sweep a circle about the vertical support 14. A rotating device 22 extends from below the power head 20 and mounts a tether 24. At the bottom of tether 24 a weight 26 is connected. A remote-control box 28 is connected through a cord 30 to the support stand The rotating device 22 is powered by a motor in head 20. The speed of rotation of device 22 can be adjusted by the control box 28. When the device 22 is rotating, tether 24 twists in the direction of rotation. The twisting tether 24 ultimately causes weight 26 to spin following the movement of rotating device 22. However, because of the inertia of weight 26, the spinning of weight 26 will always lag the rotation of device 22 so that there will always be twists in the tether 24. Depending on the speed of rotation of device 22, the number of twists in tether 24 can be controlled. As the number of twists in tether 24 increases, the effective length of the tether decreases and the weight 24 is drawn upwardly to produce an apparent flying motion.

In addition, power head 20 may be made to orbit about vertical support 14 and weight 26 may be made to follow a circular path below power head 20, as will be discussed. Therefore, the weight 20 can be made to rise or fall vertically, circle below power head 20, and circle around the base 14.

Figure 9:
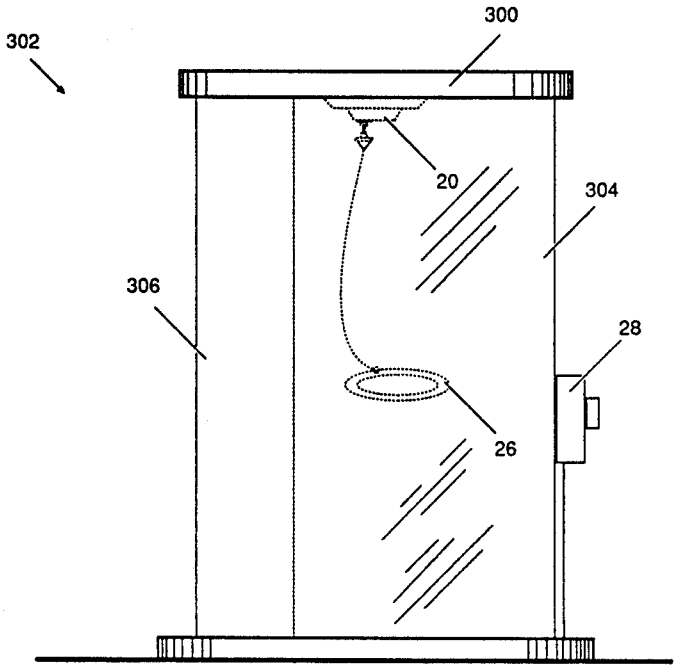
FIG. 9 shows a fully-enclosed embodiment of the present invention.

FIG. 9 shows an embodiment of the invention in which the power head 20 is mounted directly to the top wall 300 of an enclosure 302. In this configuration, the invention can operate as a coin-operated game, or a kinetic sculpture in which transparent walls 304 formed of clear plastic are provided in front and a dark-painted background 306 is provided behind the weight 26. The control box 28 is mounted on the front of the device.

Figure 10:
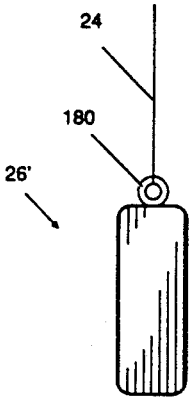
FIG. 10 shows one embodiment of the weight.
Figure 11:
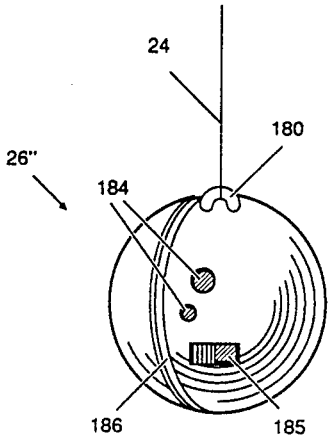
FIG. 11 shows a second embodiment of the weight.
Figure 12:
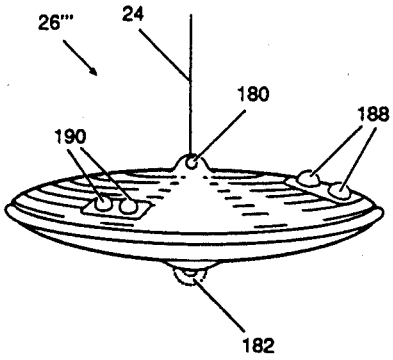
FIG. 12 shows a third embodiment of the weight.

The weight 26 can be configured in any number of shapes. The shape of this weight determines the gyroscopic properties of the weight and determines how the tether coils. A typical elongated shape for the weight is shown in FIG. 10 at 26'. An eyelet 180 is provided for connection to the tether. FIG. 11 shows a spherical weight 26'' with eyelet 180. FIG. 12 shows the disk-shaped weight 26''' with eyelet 180 for connection to the tether. If desired, a plurality of weights can be connected one above another by adding a second eyelet 182 at the bottom of the weight. Eyelet 182 is shown in phantom in FIG. 12 as attached to the bottom of weight 26. However, a similar second eyelet could be added to any shaped weight. Accordingly, for example, spherical weight 26'' could be hung below disk-shaped weight 26'''.

The weight can be made to produce interesting sounds by drilling holes in the weight or forming grooves in the surface of the weight. FIG. 11 shows a pair holes 184 drilled in the weight and a groove 186 formed around the weight. Similar holes and grooves could be formed in any shape weight. Further, reeds 185 can be attached to a weight to produce sound.

The weights could also be formed with lights using LED's and a small battery in the core of the weight. Electric circuits can be used to make the LED's pulsate at high frequencies which create unusual light effects when the weight revolves at different speeds and when the weight moves through space The lights could be arranged side by side or in any desired configuration. In FIG. 12, a pair of lights 188 is shown extending radially along the weight 26'''.

When the lights 188 are arranged radially and pulsate at a high frequency, the results are that the different lights produce the illusion that there are many lights and at the moments between pulses the lights appear to move. At faster speeds of the weight revolving the number of separate pulses of light decrease.

A second pair of lights 190 is shown extending circumferentially about the weight. When the lights 190 are arranged circumferentially and are also pulsating at a fast rate, the result is that the lights travel in overlapping paths and when different light primary colors such as a red LED, a green LED and a blue LED are used the lights mix and produce various colors at different speeds. An example would be a red and green LED mixing to form a yellow band of light at certain speeds.

When the effect of a spaceship with lights is needed in a photograph, the frequency of the pulsing lights should be adjusted to the speed of the film to produce the optimum effect.

The tether 24 can be any desired type of string. The most important qualities of the tether are flexibility and durability. Phosphorescent dyes can be used to produce an interesting effect in the dark.

In order to further produce the effect of flying, microfilament can be used for the tether. If a special effect of a spaceship is needed for a film, the tether can be of non-photographic blue color.

Figure 13:
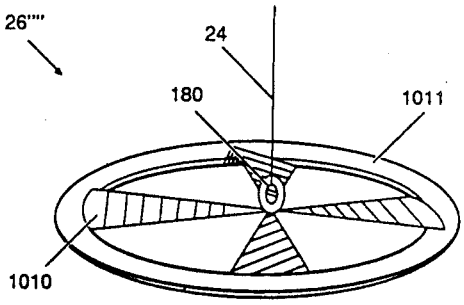
FIG. 13 shows another weight form with a propeller in its center.

FIG. 13 is a top view of a weight with a propeller 26''''. The rim 1011 contains any number of blades 1010 to propulse air in a downward direction. The tether 24 attaches to an eye 180 in the center of the weight 26''''. The rim 1011 is optional.

Figure 14:
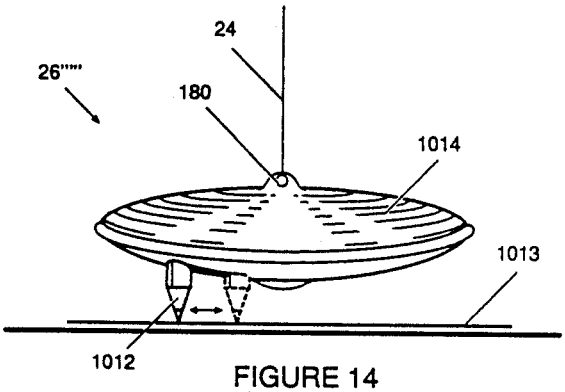
FIG. 14 shows a weight with a movable writing instrument on its bottom side.

FIG. 14 is of a weight 26''''' that can draw designs. The weight 1014 can hold one or more drawing elements 1012 on its underside. The drawing elements 1012 can be arranged in various positions. The tether 24 attaches at eyelet 180. The drawing element 1012 while spinning leaves marks on the paper 1013 when the two come into contact.

Figure 15:
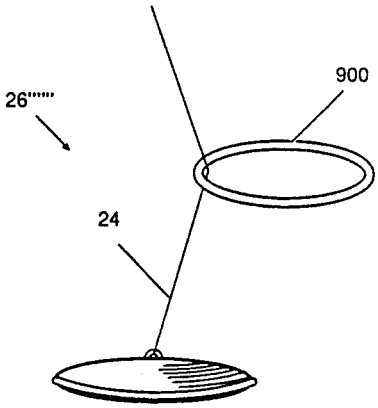
FIG. 15 is an elevational view of a hoop riding on the tether.

FIG. 15 is of a hoop 900 which spins around freely on the tether 24 when the weight 26 is spinning, unusual optical effects are produced on the string. One or many such shapes, not necessarily round, can be placed on the string at one time, and can be colored with phosphorescent dyes.

Figure 16:
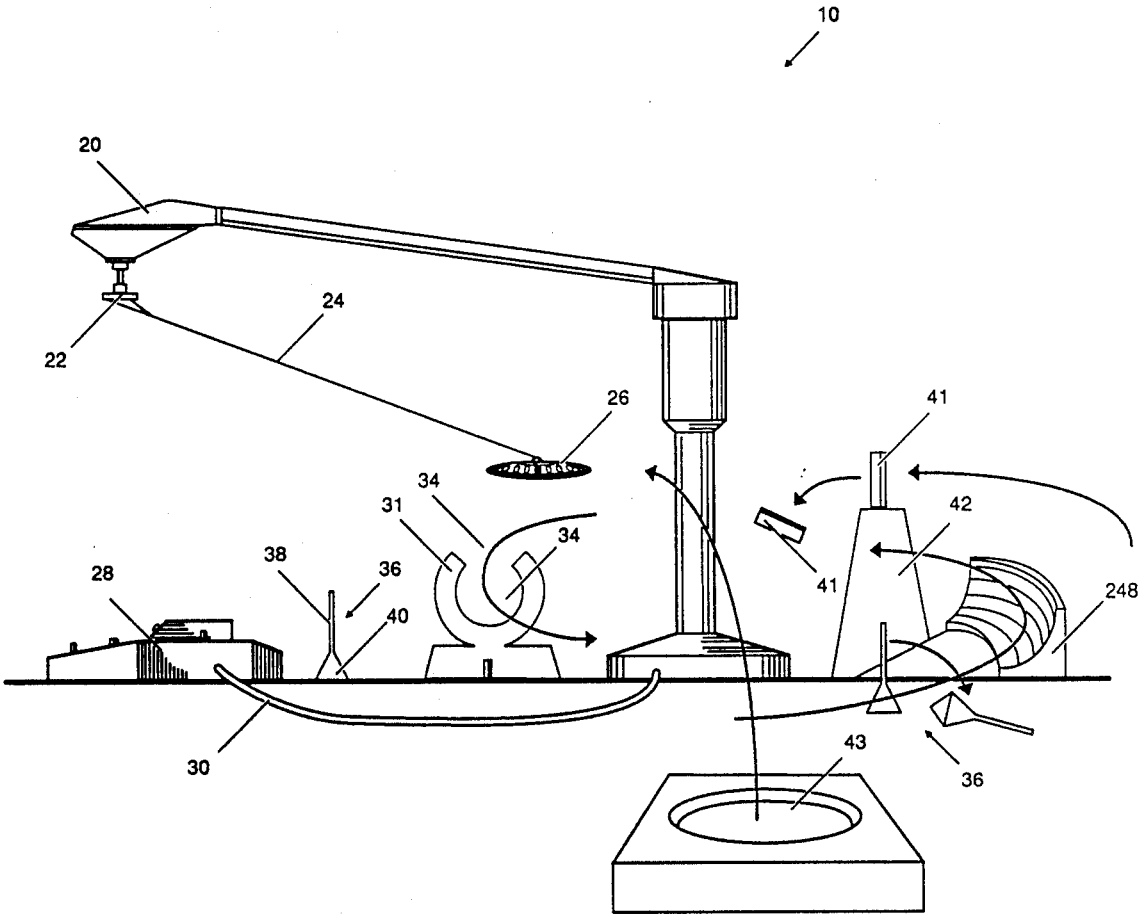
FIG. 16 is an elevational view showing the possible directions of movement of the flying weight portion of the toy and interaction between weight and game forms.

FIG. 16 depicts the manner in which the toy can be used as part of a game. In FIG. 16, the weight 26 is configured as a disk so as to resemble a flying saucer. A stationary obstacle 31 has a central opening 32 through which the disk 26 can pass and a vertical opening 34 through which the tether 24 can pass. Accordingly, by controlling the power head 20, appropriately, the disk 26 can be oriented in both height and circular arc to pass through opening 32. Points may be given for achieving this desired result.

A second stationary object 248 is a banked track which the disk 26 can move towards. When the disk contacts the banked track 248, the result is a change in direction of the disk 26.

A movable target 36 is also shown. Target 36 has an elongated member 38 and a widened base 40. By contacting elongated member 38 with disk 26, target 36 can be made to fall over. As will be discussed in further detail hereinafter, points may be given for knocking the target over and for knocking it over in a particular direction.

A second type of movable target 41 is shown. Target 41 is simple in nature and can be knocked off of the obstacle 42 by the weight 26. Points may be scored by a player according to how many targets are knocked over.

A third group of stationary objects comprise the landing areas 43. These forms have concave top surfaces to aid the disk 26 to remain on these areas once it touches down because it spins like a top when on a smooth surface.

Figure 17:
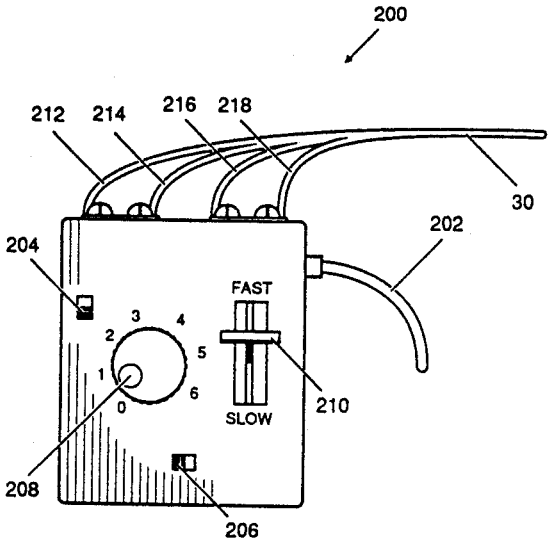
FIG. 17 shows the face panel of a control box for the device.

FIG. 17 shows a control panel 200 having a power cord 202 and cable 30. Panel 200 can use the face of the control box 28. Panel 200 has an on/off switch 204 and is designed to control a single motor. The direction of rotation of the motor is controlled by an optional forward-reverse switch 206 and motor speed is controlled by a rotatable knob 208. It will be understood that a separate control knob 208 and forward-reverse switch 206 may be provided for each motor to be driven. Only a single control knob and switch are shown in FIG. 17 for simplicity. However, up to three such combinations may be provided on the control panel. Also, a power control slider switch 210 is provided to control a strobe on the motor housing 210. The lights may be stroboscopic and the slider switch 210 can control the speed pulse of the lights. Again, only a single switch is shown, it being understood that a separate switch will be provided for each set of lights to be controlled individually.

The cable in FIG. 17 is shown to contain four wires. Two of the wires 212 and 214 extend to the motor being controlled. The other two wires 216 and 218 provide power to the strobe being controlled.

Figure 18:
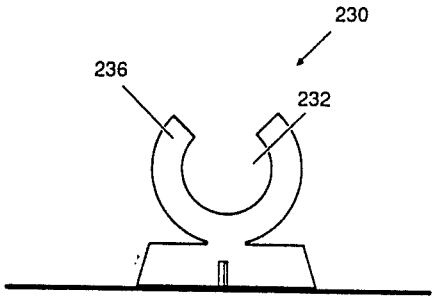
FIG. 18 shows one embodiment of a stationary object to be used with the game of the present invention.

FIG. 18 shows a stationary object 230 to be used with any shaped weight 26. Object 23 has a circular opening 232 through which the weight 26 can pass. The opening 234 in the top permits the tether to pass through. Points are given for successfully passing the weight through the opening 232 without knocking over stationary object 230.

Figure 19:
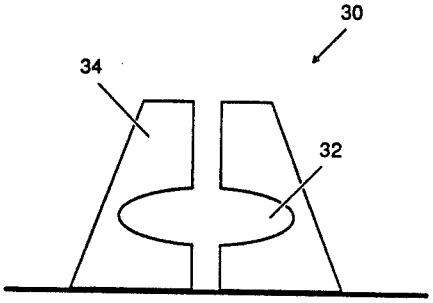
FIG. 19 shows a second embodiment of a stationary object to be used with the game of the present invention.

FIG. 19 shows a stationary object 30 which has a disk-shaped opening 32 for permitting disk-shaped weight 26 to pass through. A vertical opening 34 is provided to allow the tether 24 to pass through. It will be noted that stationary object 30 is actually formed in two parts so that the distance between the parts can be varied in order to increase or decrease the difficulty of passing the weight 26 through opening 32. In other words, the size of the opening 32 can be increased or decreased to vary the difficulty of the game.

Figure 20:
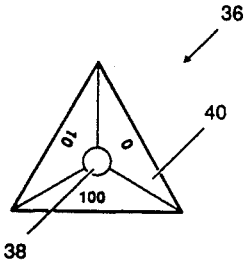
FIG. 20 shows a top plan view of the object in FIG. 21.
Figure 21:
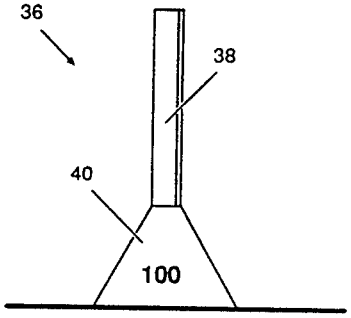
FIG. 21 shows a third embodiment of a target to be used with the game of the present invention.

FIGS. 20 and 21 show the stationary object 36 which has base portion 40 and upright 38. It will be seen that the base portion 40 is formed as a pyramid with each side of the pyramid given a different value. For example, these values may be zero, one hundred and three hundred, respectively. Points are given for knocking stationary objects 36 over and a number of points is determined in accordance with the direction in which the object is tipped over. For example, if the object is tipped over on the one hundred point side of base 40, one hundred points are allocated.

Figure 22:
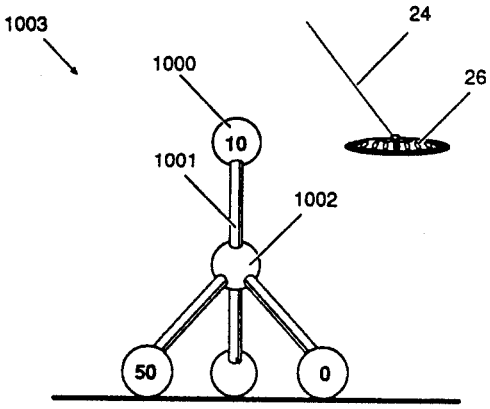
FIG. 22 shows a fourth embodiment of a movable target used in the game.

FIG. 22 shows another target 1003 which can be knocked over by the weight 26. Points are scored by moving the target around to cause the knob 1000 having the highest point value to point in the air. All the knobs 1000 connect at a center piece 1002 by arms 1001. More extentions can be added to the center if desired.

Figure 23:
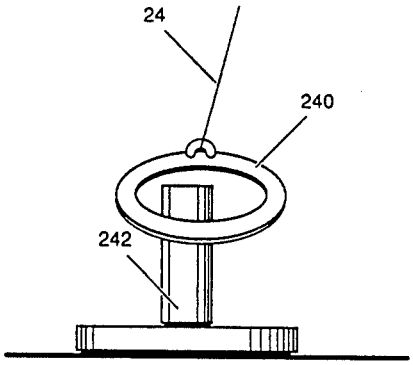
FIG. 23 shows a fifth embodiment of a stationary object to be used with the game of the present invention.

FIG. 23 shows tether 24 connected to a ringshaped weight 240. Weight 240 will rise to a horizontal position when it begins spinning at a high speed. This form or any form with an open center can be maneuvered over a post 242 to form a type of ring toss game. Points are given for successfully placing the ring 240 over the post 242.

Figure 24:
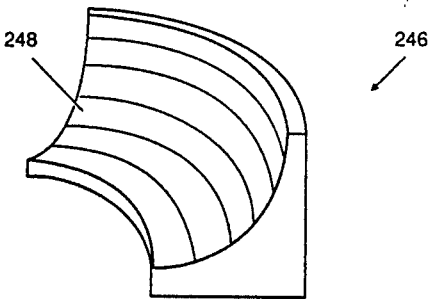
FIG. 24 shows a sixth embodiment of a stationary object to be used with the game of the present invention.

FIG. 24 shows a banked track 246 which has a curved pathway 248. Any one of the round sided spinning weights can be maneuvered against the curved pathway 248 to change direction of travel of the weight. Banked tracks 246 can be formed in a full circle design, a half circular design, quarter circular design or linear sections. To assist in interaction between the weight and the banked track 246, a rubber coating may be applied to the portion of the weight which will contact the path 248.

Figure 25:
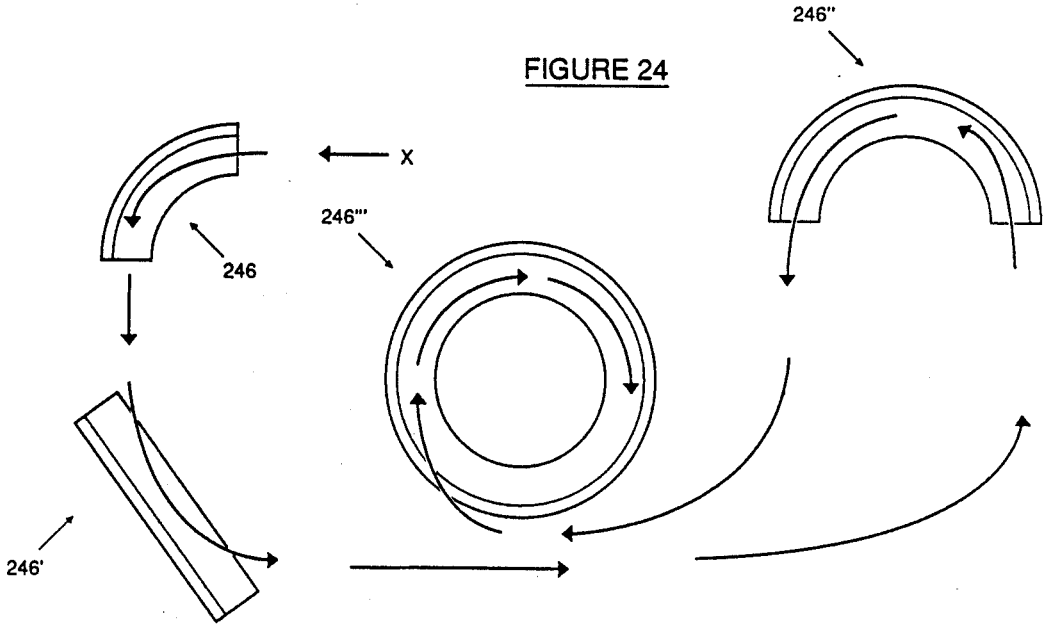
FIG. 25 shows a plan view a typical flight pattern to be followed using the game of the present invention.

FIG. 25 shows the manner in which banked tracks 246 can be used. With the weight starting at point X, following the dotted path, a one quarter circle banked track 246 is first encountered. This causes the weight to change direction and head toward a linear banked track 246'. The weight can then continue on and contact half circle banked track 246" which causes the weight to circle back on itself. The weight then travels inwardly and can be placed in a full circle banked track 246'''. By raising and lowering the weight with the appropriate controls discussed above, the banked tracks can either be contacted or avoided by the user.

Figure 26:
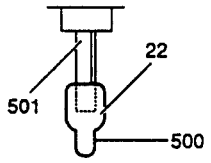
FIG. 26 is a side view of the single-eye tether connection.
Figure 27:
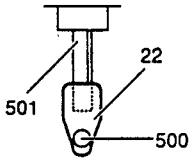
FIG. 27 is another side view of FIG. 26 from a perpendicular angle.

FIG. 26 is a side view of the tether connection 22 with the motor axle 501 penetrating this rotating device 22 which has a single opening 500 for the tether to be tied to. FIG. 27 is a front view of the tether connection. The tether connection can be separate from the axle 501 or be an extended element of the axle 501.

Figure 28:
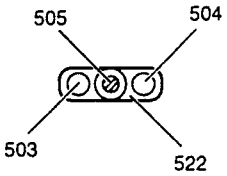
FIG. 28 is a top view of a double-eye tether connection.
Figure 29:
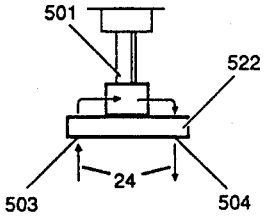
FIG. 29 shows how the string is threaded through the double-eye tether connection.

FIG. 28 is a top view of a tether connection 522 with two openings 503 and 504. The axle 501 fits into the hole 505. FIG. 27 is a side view of FIG. 29, demonstrating how the tether 24 is threaded through the openings 503 and 504.

Figure 30:
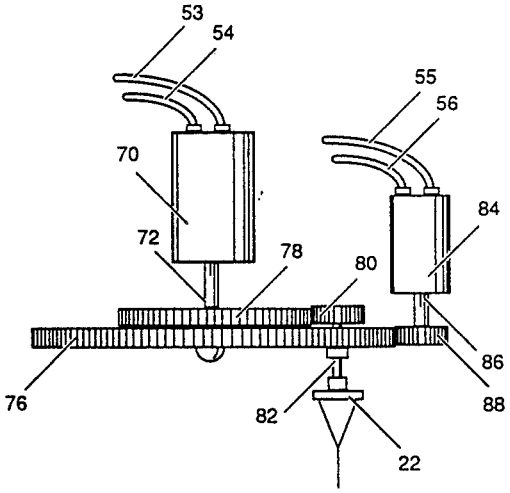
FIG. 30 is a schematic view showing a two-motor power head for the toy.

FIG. 30 shows a first embodiment of the motor construction in power head 401 or 20. A first motor 70 is mounted in the power head and includes a shaft 72. Shaft 72 rotatably supports a gear 76 and is fixedly mounted to a gear 78. Gear 78 meshes with gear 80. Gear 80 has a shaft 82 which is journaled within gear 76 and which mounts the rotating device 22. A second motor 84 is also mounted within the power head 20 and has a shaft 86 which is fixedly connected to a gear 88.

Figure 36:
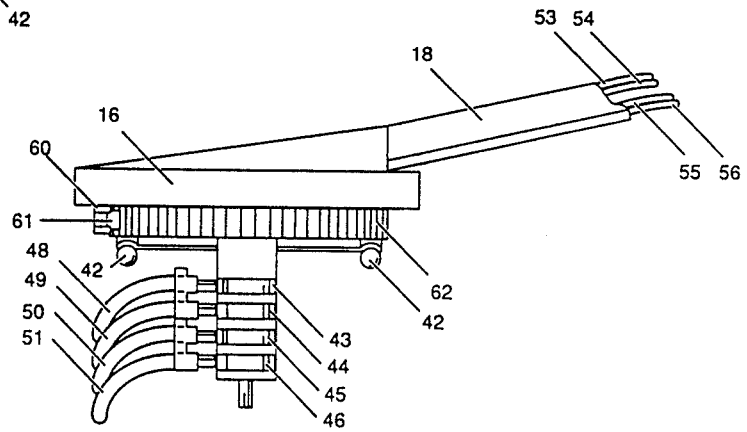
FIG. 36 is a view showing the electrical connections for the support arm of the toy.

Accordingly, motor 70, through gear 78 and gear 80, controls the spinning movement of rotating device 22, whereas motor 84 through gear 88 and gear 76 causes the spinning device 22 to follow a circular path having shaft 72 as its center. The speed of rotation of device 22 is controlled by motor 70 and thus the height of the weight 26 is also controlled by this motor. Motor 84 controls the circular movement of weight 26 below the power head. When this power head is mounted in device 10, power head 20, the circular movement creates a reaction force in arm 18 which causes the arm 18 to orbit. As will be understood with reference to FIG. 8, when weight 26 is moving in a clockwise direction viewed downwardly from head 20, and if the ratchet mechanism 60 of FIG. 36 is set to permit arm 18 to rotate in a clockwise direction also, one half of the circular movement of weight 26 will force arm 18 to move clockwise and the other half of the circular movement will produce no effect on arm 18 due to the ratchet.

Figure 31:
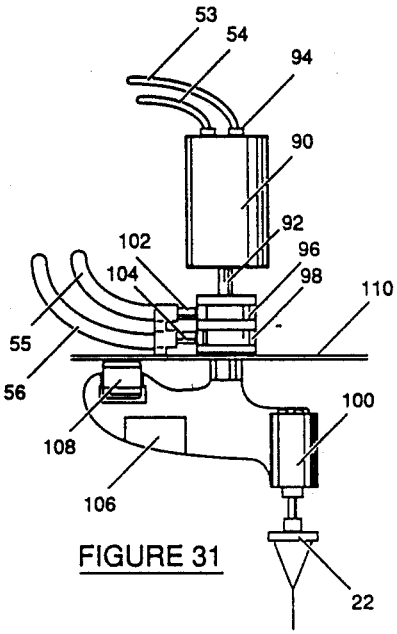
FIG. 31 shows a second embodiment of a two-motor power head for the toy.

FIG. 31 shows a second embodiment of the motor configuration in power head 401 or 20. In FIG. 31, a motor 90 is mounted in the power head and includes a shaft 92 to which a bracket 94 is mounted for rotation. Slip rings 96 and 98 also rotate with the shaft 92. A motor 100 is mounted in bracket 94 and is supplied with power through the slip rings 96 and 98 which contact brushes 102 and 104. A counterweight 106 is mounted in bracket 94 and a bearing 108 rests against a support surface 110 in the power head. The rotating device 22 is mounted to the shaft of motor 100. Accordingly, in this embodiment, motor 100 controls the twist of tether 24 and motor 90 controls the circular movement of the weight 26.

Figure 32:
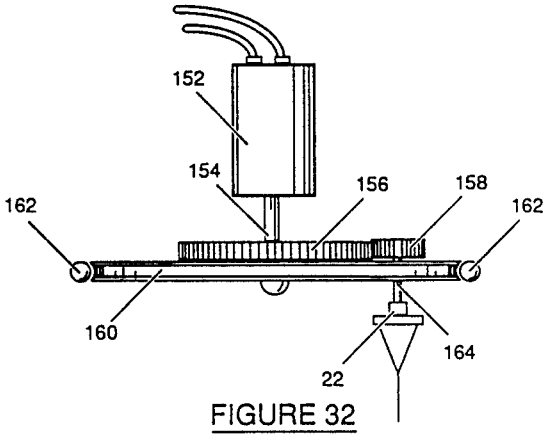
FIG. 32 shows a one-motor power head for the toy.

FIG. 32 shows an embodiment of the power head in which only a single motor 152 controls both the speed of rotation of rotating device 22 and the orbital position of the rotating device. A shaft 154 of motor 152 is connected to a gear 156 which meshes with a gear 158. Gear 158 rotates device 22. A disk 160 is rotatably mounted in ball bearings 162 and the shaft 154 passes through disk 160 and supports and journals the disk 160 so that it rotates relative to shaft 154. Shaft 164 which is attached to gear 158 and mounts device 22 is also journaled in disk 160. Motor 152 drives gear 156 which in turn drives gear 158. Disk 160 is independent of gears 156 and 158 and the motor shaft 154. The disk 160 turns as a result of the resistance of gear 158 to turning. Accordingly, orbital motion of the device 22 is generated.

Figure 33:
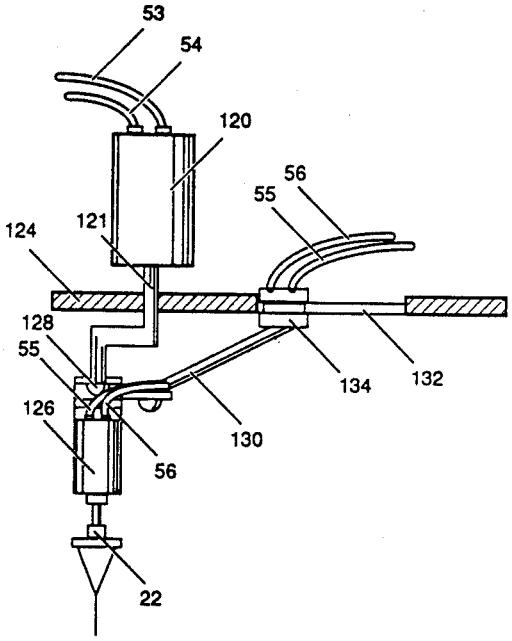
FIG. 33 shows a third embodiment of a two-motor power head for the toy.

FIG. 33 shows an embodiment wherein a motor 120 is mounted in the power head. Motor 120 has a crank-shaped shaft 121 which extends through and is journaled in a support plate 124. A second motor 126 is supported on the tip of the shaft 121 by a bearing 128. Accordingly, motor 126 can rotate relative to shaft 121. A support arm 130 is fixedly attached to motor 128 and extends through a slot 132 in support plate 124. Arm 130 terminates in an enlarged member 134 which rides above the slot. Accordingly, motor 120 turns the crank 121 which causes motor 126 to follow a circular path. Motor 126 rotates device 22 and causes the tether to twist. As crank 121 rotates, shaft 130 slides back and forth in the slot 132 keeping the motor 126 in a relatively stable orientation. Leads 53 and, 54 can be connected directly to motor 120. Leads 55 and 56 may ride along shaft 130 and connect to motor 126.

Figure 34:
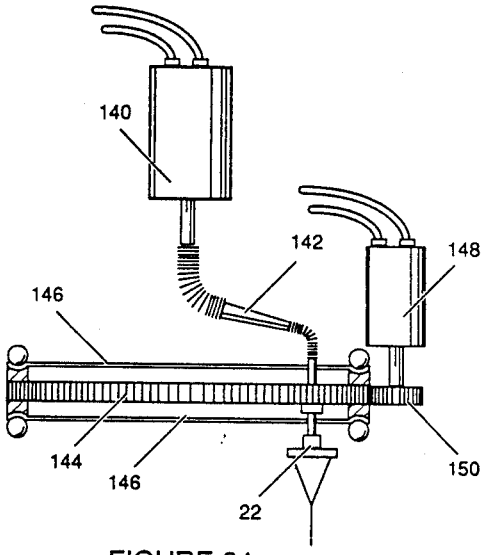
FIG. 34 shows a fourth embodiment of a two-motor power head for the toy.

FIG. 34 shows an embodiment of the power head 401 or 20 in which the first motor 140 is mounted within the power head and drives the rotating device 22 through a flexible coupling 142. Rotating device 22 is journaled in a gear 144. Gear 144 is mounted by ball bearing supports 146 and driven by motor 148 through a drive gear 150. It is will be understood that bearings 146 position the gear 144 as well as support it. From the foregoing, it can be seen that the motor 140 drives the rotating device so as to control the twist in the tether whereas motor 148 controls the orbiting of the drive device 22 and thus the orbital position of the weight attached to the tether.

Figure 35:
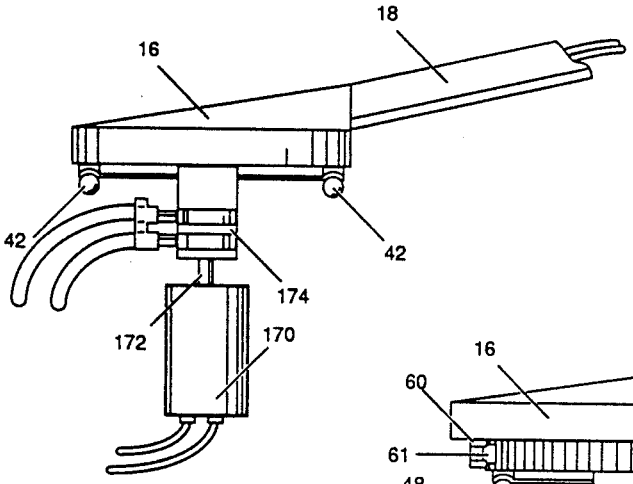
FIG. 35 shows a motorized support arm for the toy.

FIG. 35 shows an embodiment in which the cap 16 is positively rotated by a motor 170. Motor 170 is mounted in the vertical support 14 and includes a shaft 172 which mounts the cap 16 and the slip ring arrangement 174. Only two slip rings are shown in FIG. 9 so that only the single-motor power head of FIG. 8 can be driven by this arrangement. However, four slip rings as shown in FIG. 36 can be used to power a two-motor power head.

FIG. 36 shows the rotatable cap 16 which rides on bearings 42 are mounted on a supporting ridge (not shown) in the vertical support 14. Slip rings 43, 44, 45, and 46 are mounted for rotation with cap 16 and brushes 48, 49, 50, and 51 contact the slip rings 43 through 46 respectively to provide electrical power thereto. The electricity is passed through four conductors 53, 54, 55, and 56 to the power head 20 to operate motors in the power head, as will be discussed in further detail below.

In the embodiment shown in FIG. 36 movement of cap 16 and arm 18 is generated by a reaction force generated in response to circular movement of the weight. In order to enable the cap 16 to follow a full circular path, a ratchet device 60 is provided. The ratchet device 60 comprises ratchet teeth 62 formed on the cap 16 and a ratchet lever 64 which is spring loaded and is mounted in the vertical support 14. The mounting for the ratchet lever 64 is not shown. However, the ratchet works as a standard ratchet mechanism permitting movement of the cap 16 in one direction only. The lever 64 can be set to permit either clockwise or counterclockwise rotation of the cap 16.

The foregoing description is set forth for purposes of illustrating the invention but is not deemed to limit the invention in any way. Clearly, numerous additions, changes and other modifications can be made without departing from the scope of the invention as set forth in the appended claims.

What is claimed is:

1. A device comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether; and means for causing said twisting means to periodically orbit so as to move said weighted object horizontally whereby three-dimensional movement of said object can be achieved, said means for twisting said tether having a rotating shift defining an axis, said second end of said tether attached to said means for twisting at a point off-axis said axis of said rotating shaft.

2. A device according to claim 1 wherein phosphorescent dye has been applied to said tether to make the tether glow in the dark.

3. A device according to claim 1 wherein a non-photographic blue dye is applied to said tether to make the tether invisible when filmed.

4. A device according to claim 1, wherein the tether is stroboscopically illuminated with a strobe and including a control for the frequency of the strobe so the strobe frequency can be varied.

5. A device according to claim 1 including a means for controlling said twisting means to control the position of said weighted object.

6. A device according to claim 5 wherein said controlling means is remote from said twisting means.

7. A device according to claim 1, wherein said twisting means includes a motor in a motor housing further comprising:

legs for connecting said motor housing to a surface below the level of said motor housing; and a string for connecting said motor housing to a surface which is one of at and above the level of said motor housing, so that said leg and said string combine to support said motor housing.

8. A device according to claim 1 wherein said twisting means includes a motor in a motor housing, further comprising at least three legs supporting the motor housing off the ground.

9. A device according to claim 1 wherein said weighted object is in the form of a sphere.

10. A device according to claim 1 wherein said weighted object is in the shape of a disk.

11. A device according to claim 1 wherein said weighted object is in the form of a ring.

12. A device according to claim 1 wherein said weighted object has an open center which contains vanes which function to propel the weighted object upward when it spins.

13. A device according to claim 1, wherein said weighted object includes at least one writing element beneath the weighted object to interact with a drawing surface to produce designs exhibiting periodic features related to orbiting of said weighted object.

14. A device according to claim 1 wherein said weighted object includes means for producing sounds when the weighted object spins.

15. A device according to claim 14 wherein said means for producing sounds when the weighted object spins comprises at least one reed-type element.

16. A device according to claim 14 wherein said means for producing sounds when the weighted object spins comprises at least one fluted area in the weighted object.

17. A device according to claim 14 wherein said means for producing sounds when the weighted object spins comprises a grooved area on the weighted object.

18. A device according to claim 1 wherein said weighted object includes means for producing visible light.

19. A device according to claim 18 wherein said light producing means comprises several lights arranged circumferentially about the weighted object resulting in a mixture of lights.

20. A device according to claim 19 including means causing the lights to pulsate.

21. A device according to claim 19 wherein said light producing means comprises several lights arranged radially from the center of the weighted object.

22. A device according to claim 1 including at least one target positioned within the range of movement of said weighted object.

23. A device according to claim 22 wherein said target is designed to be knocked over by contact with said weighted object.

24. A device according to claim 23 wherein said target is vertically elongated and has a base that has at least three flat sides which limit the angles along which the target may fall when knocked over by contact with said weighted object.

25. A device according to claim 23 wherein said target has a tetrahedral base having an apex from which a rod extends laterally which provides the leverage necessary for the weighted object to knock over the target.

26. A device according to claim 22 wherein said target has a vertically extended member and wherein said weighted object has an open center for receiving said member so that said weighted object can land onto the member.

27. A device according to claim 22 wherein said target is a stationary banked track which has a pathway for the weighted object to be maneuvered against to change its direction of travel.

28. A device according to claim 1 wherein said means for causing said twisting means to orbit includes an elongated support member mounting said twisting means, and means for rotating said elongated support member about a central position.

29. A device according to claim 28 including a vertical support member rotatably supporting said elongated support member at said central position.

30. A device according to claim 29 wherein said means for rotating said elongated support member comprises a motor mounted in said vertical support member which directly rotates said elongated support member.

31. A device, comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether; and means for causing said twisting means to periodically orbit so as to move said weighted object horizontally whereby three-dimensional movement of said object can be achieved; and a second tether attached at a first end thereof to said weighted object and a weight attached to a second end of said second tether.

32. A device, comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether;

means for causing said twisting means to periodically orbit so as to move said weighted object horizontally whereby three-dimensional movement of said object can be achieved; and at least one hoop positioned on the tether and which is freely rotatable thereabout.

33. A device according to claim 32 wherein said hoop is colored with phosphorescent dye.

34. A device, comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether;

means for causing said twisting means to periodically orbit so as to move said weighted object horizontally whereby three-dimensional movement of said object can be achieved; and at least one target positioned within the range of movement of said weighted object, wherein said target has a first opening sized to permit said tether to pass through and a second opening sized to permit said weighted object to pass through, said first opening being narrower than said second opening and said weighted object.

35. A device according to claim 34 wherein said target has a center point, at least four equal extensions radiating from said center point, each extension terminating in an equal sized member to be knocked over by said weighted object to change the position of the target in relation to the ground.

36. A device comprising:

a weighted object;

a flexible tether attached at a first end thereof to said weighted object;

means mounted in a power head positioned above said tether and above said weighted object and connected to a second end of said tether for twisting said tether to cause said weighted object to spin and for raising and lowering said weighted object as a result of coiling of said tether; and means mounted in said power head for causing said twisting means to periodically orbit so as to move said weighted object horizontally whereby three-dimensional movement of said object can be achieved, said orbiting means including an elongated support member mounting said twisting means, and means for rotating said elongated support member about a central position.

37. A device according to claim 36 further including a generally horizontal support member to which said power head is mounted, said generally horizontal support member being mounted for rotation about a pivot point.

38. A device according to claim 37 including means for constraining said elongated member for rotation in only one direction.

39. A device according to claim 26 wherein said twisting means comprises a device for mounting said tether and a first motor for rotating said mounting device, said mounting device being journaled in a gear, and said orbiting means comprising a second motor for rotating said gear to move said mounting device about an axis of said gear.

40. A device according to claim 36 wherein said twisting means includes a first motor and said orbiting means including a second motor having a crankshaped motor.

41. A device, comprising:

a weighted object;

a flexible tether attached to a first end thereof to said weighted object;

means mounted in a power head positioned above said tether and above said weighted object and connected to a second end of said tether for twisting said tether to cause said weighted object to spin and for raising and lowering said weighted object as a result of coiling of said tether, said twisting means comprising means for mounting said tether, said mounting means being attached to a first gear, said first gear being journaled in a circular plate at a position spaced from an axis of said circular plate and a single motor for rotating both said circular plate and said gear, and means mounted in said power head for causing said twisting means to periodically orbit so as to move said weighted object horizontally whereby three-dimensional movement of said object can be achieved, said orbiting means including an elongated support member mounting said twisting means, and means for rotating said elongated support member about a central position.

42. A device, comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether, said means for twisting said tether having a rotating shaft defining an axis, said rotating shaft being drivingly connected to said tether such that rotation of said shaft causes circular movement of said tether, said rotating shaft extending downwardly from means causing said shaft to rotate, said shaft being positioned entirely above said tether, said second end of said tether attached to said means for twisting at a point off-axis said axis of said rotating shaft; and means in said weighted object for producing visible light.

43. A device according to claim 42, further comprising means for stroboscopically illuminating said tether and means for controlling the frequency of the strobe.

44. A device according to claim 42, wherein said tether is attached to said weighted object at an attachment point, and wherein said attachment point is located off of the axis above which said weighted object spins.

45. A device according to claim 44, wherein said weighted object is in the form of a ring.

46. A device according to claim 42, wherein said light producing means comprises a plurality of lights arranged circumferentially about the weighted object resulting in a mixture of lights.

47. A device according to claim 42, wherein said light producing means comprises a plurality of lights arranged in a radially-extending pattern on said weighted object.

48. A device according to claim 47, further comprising means for causing the lights to pulsate.

49. A device, comprising:

a weighted object;

a flexible tether attached at a first end thereof to said weighted object;

means above said weighted object and connected to a second end of said tether for twisting said tether to cause said weighted object to spin and for raising and lowering said weighted object as a result of coiling of said tether;

means for causing said twisting means to periodically orbit so as to move said weighted object horizontally whereby three-dimensional movement of said object can be achieved, wherein said weighted object includes at least one writing element beneath the weighted object to interact with a drawing surfact to produce designs exhibiting periodic features related to orbiting of said weighted object, wherein said writing element is offset from the axis of rotation of said weighted object.

* * * * *